United States Patent [19]

Laws et al.

[11] 4,449,575

[45] May 22, 1984

[54] FLUIDIZED BED HEATING APPARATUS

[76] Inventors: William R. Laws, 19 Tudor Ave., Worcester Park, Surrey; Geoffrey R. Reed, 8 Beechdene, Tadworth, Surrey, both of England

[21] Appl. No.: 248,043

[22] Filed: Mar. 27, 1981

[30] Foreign Application Priority Data

Mar. 28, 1980 [GB] United Kingdom ..... 8010442

[51] Int. Cl.[3] ..... F28F 7/00; F28F 9/04

[52] U.S. Cl. ..... 165/82; 165/158; 165/172; 165/175; 165/178

[58] Field of Search ..... 165/104.16, 158, 175, 165/178, 172, 162, 82; 285/137 R

[56] References Cited

U.S. PATENT DOCUMENTS

| | | | |
|---|---|---|---|
| 152,394 | 6/1874 | McCarthy | 165/175 |
| 310,375 | 1/1885 | Cannon | 165/175 |
| 2,095,643 | 10/1937 | Lehr . | |
| 2,537,024 | 1/1951 | Bay | 165/178 |
| 3,263,747 | 8/1966 | McKay | 165/178 |
| 3,305,012 | 2/1967 | Allen | 165/178 |
| 3,414,052 | 3/1968 | Chojnowski et al. . | |
| 3,468,560 | 9/1969 | Cassel | 285/137 R |
| 3,610,595 | 10/1971 | Laws | 165/176 |
| 3,696,862 | 10/1972 | Dijk | 165/178 |
| 3,776,303 | 12/1973 | Anderson et al. | 165/82 |
| 4,088,184 | 5/1978 | Cavallaro | 165/162 |
| 4,158,036 | 6/1979 | Jaffe et al. | 165/104.16 |
| 4,167,211 | 9/1979 | Haller | 165/172 |
| 4,172,312 | 10/1979 | Costick . | |
| 4,191,244 | 3/1980 | Keske | 285/137 R |
| 4,222,434 | 9/1980 | Clyde | 165/181 |
| 4,270,599 | 6/1981 | Connell | 165/162 |
| 4,284,131 | 8/1981 | Margraf | 165/178 |
| 4,304,297 | 12/1981 | Margarf | 165/175 |

FOREIGN PATENT DOCUMENTS

| | | |
|---|---|---|
| 868368 | 5/1961 | United Kingdom . |
| 2015146 | 5/1979 | United Kingdom . |

*Primary Examiner*—William R. Cline
*Assistant Examiner*—John M. Kramer
*Attorney, Agent, or Firm*—Murray Schaffer

[57] ABSTRACT

A heat exchanger for high temperature operation has a ceramic-walled chamber traversed by ceramic tubes and is capable of use inter alia in fluidised bed applications. The tubes are arranged in series of successive banks and to give a compact arrangement the successive banks of tubes at different levels are disposed transversely to each other. The tubes may have internal and external reinforcing means to allow them to withstand the loads imposed by the fluidised bed and generally to allow longer tubes to be used in ceramic constructions. The internal reinforcing means may also provide restrictions that in fluidised bed applications can function to minimise the effects of tube wall fracture by reducing carry-over of bed particles seeping into the tubes. For improved end sealing, means can be provided to hold resilient ceramic seals compressed against the tube ends while permitting axial thermal movement of the tubes.

12 Claims, 12 Drawing Figures

FIG. 5
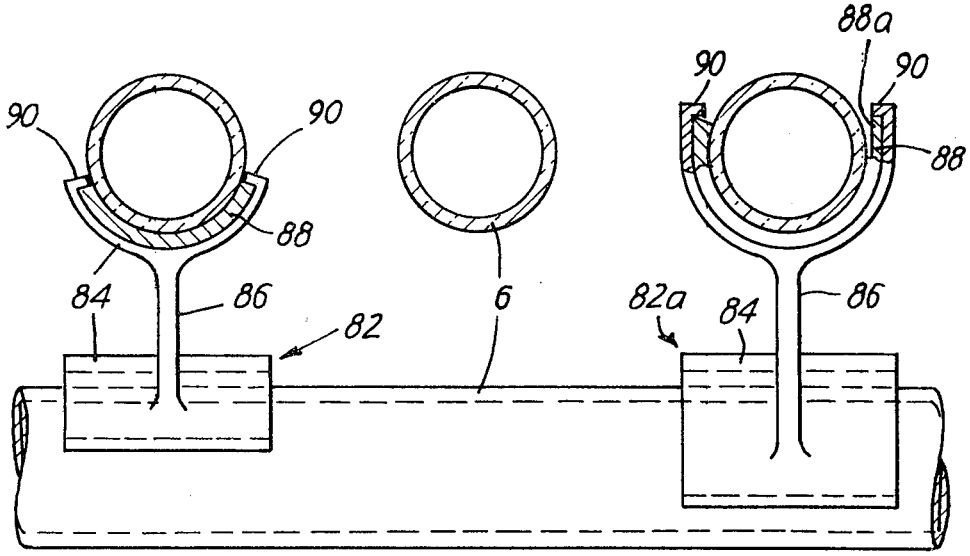
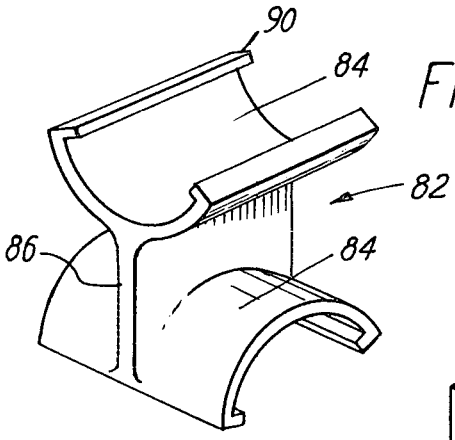
FIG. 6
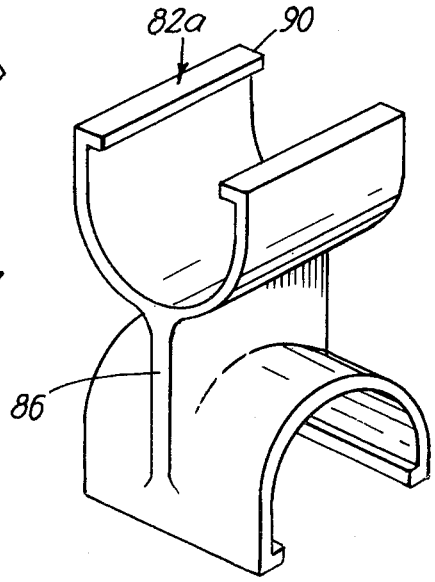
FIG. 7

2a
30a
6
17
17a
10
15
14b
14'
17b
2a
2
22

26
30b
10
6
14
14
12
17
30a
26a
2

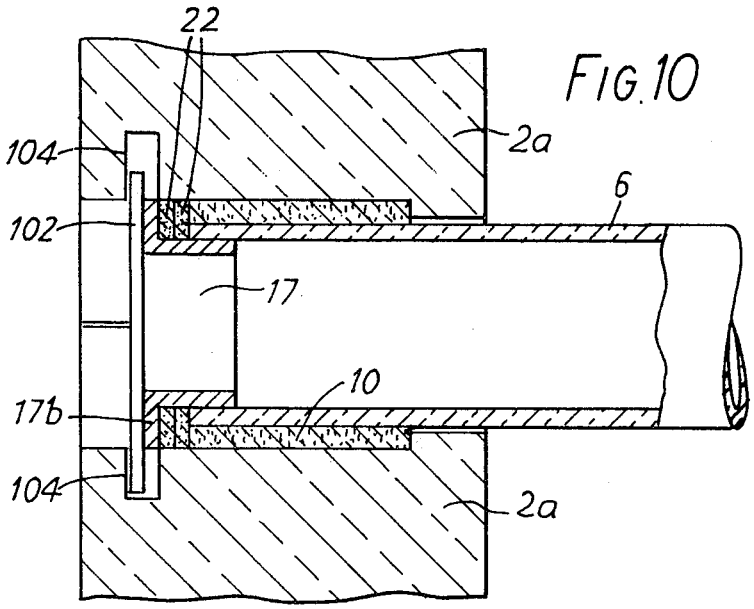
FIG. 10
FIG. 11
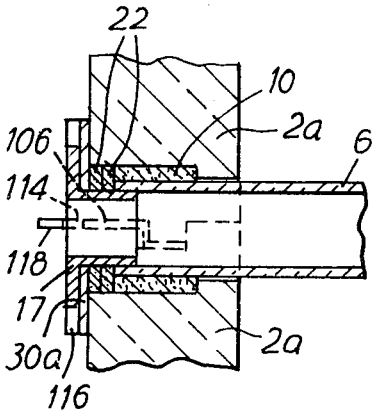
FIG. 12
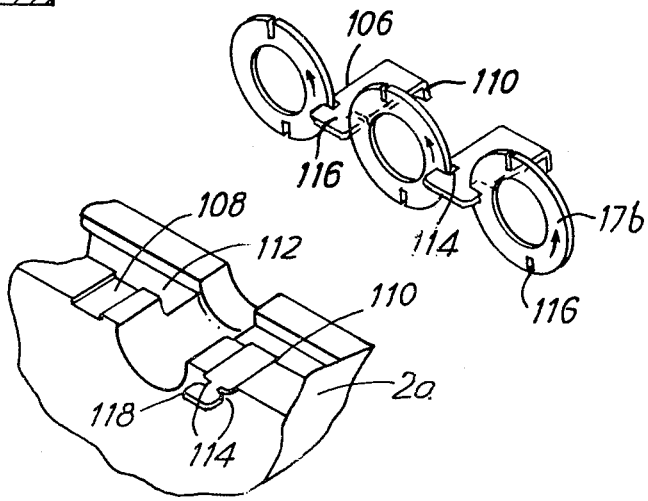

FLUIDIZED BED HEATING APPARATUS

BACKGROUND OF THE INVENTION

This invention relates to high temperature heat exchangers and particularly, although not necessarily exclusively, heat exchangers in which a fluidised bed provides one of the materials in heat exchange relation.

For gas-to-gas heat exchange at temperatures too high for metal constructions, it is known to use ceramic heat exchangers, because they are capable of operating at higher temperatures than are obtainable from metal constructions. The use of ceramic materials poses a number of difficulties however.

For example, ceramic constructions are bulky as compared with metal constructions. This is firstly due to the relatively poor thermal conductivity of ceramics as compared with metals, and also because they cannot match the high heat transfer coefficients of a metal construction, particularly when the fluid to be heated is a liquid or gas under pressure. The total tube surface area in a ceramic heat exchanger must be of the order of four times its metal equivalent for the same heat transfer rate.

The bulk of a ceramic construction is increased further because of the more complex sealing arrangements required for the tube ends in order to limit thermal expansion stresses on the ceramic tubes. The minimum spacing between tubes is limited because of this requirement and even using a compact arrangement as described in U.S. patent application Ser. No. 6/9769 the tubes cannot be pitched closer than 1.8 tube diameters.

Although there may be many instances where the user is not concerned by the bulk of the apparatus, this adds to the cost and itself imposes design difficulties. For a given heat exchange rate, the total volume could be increased by increasing the length and numbers of the tubes, but increasing length accentuates the problems of material weakness as already mentioned, and it is undesirable to employ a plan form that is markedly oblong if heat losses are to be minimised.

Further problems arise from the brittle nature of ceramic materials, and especially their weakness in tension as compared with metals. In a tubed heat exchanger, where it is desirable to employ thin-walled tubes for efficiency of heat transfer, particularly having regard to the poor thermal conductivity of ceramics as compared with metals, these inherent weaknesses of ceramic materials can be a serious limitation.

The weakness of ceramic materials is also a significant factor in the problems that arise when trying to make seals between ceramic tubes and the end walls of a heat exchange chamber because of the need to allow for relative thermal expansion in high-temperature operation without overstressing the material. These difficulties are accentuated if the seals have to be capable of withstanding relatively high pressure differentials. Because of the fragility of ceramic materials and their high operating temperatures, seals suitable for metal heat exchanger tubes cannot be adapted to ceramic tubes.

Metal-tubed heat exchangers are also already known for fluidised bed heating apparatus. Such apparatus has gained acceptance in application to compact boilers and shallow bed water heaters, because of its advantages in being able to provide high heat transfer rates and uniform heating. In known systems, heat is extracted from the fluidised bed by passing the fluid to be heated, e.g. water or steam, through metal tubes which are submerged in the bed. There would be distinct advantages from the application of ceramic constructions to fluidised bed systems. For example, if heating clean air to high temperatures it is possible to show by theoretical calculations that a fluidised bed at 900° C. could give heat transfer rates equivalent to a heat input in the form of a hot gas stream at 1600° C.

However, ceramic material constructions have not been adopted for fluidised bed heating apparatus for practical reasons, and in particular because all the problems indicated above that come with the use of such materials would be encountered in a particularly severe form. For example the ceramic tubes submerged in the bed would be subjected to random forces greater than those typically experienced in a gas-to-gas heat exchanger and such forces can generate considerable local pressures that may crack a brittle ceramic material.

The increased bulk of ceramic constructions is also a disadvantage which is particularly apparent in the fluidised bed apparatus where it is possible to achieve a very high intensity of heating that allows compact metal constructions to be produced. Even if this disadvantage is accepted and the output rating of a fluidised bed apparatus using ceramic tubes is increased by accommodating more tubes in a deeper bed, that requires an increase of the fluidising gas pressure, which produces other problems.

The present invention has a special application to such fluidised bed heat exchange apparatus, although it can be usefully applied to other high temperature applications, such as for gas-to-gas exchangers.

SUMMARY OF THE INVENTION

According to one aspect of the present invention, there is provided heat exchange apparatus having a chamber with two opposite and mutually transverse pairs of side walls each comprising a series of parallel ceramic blocks superimposed on each other and formed with recesses that provide seatings between adjacent blocks for ceramic tubes extending through the chamber, and sealing means in said seatings for the ends of the tubes, said tubes being arranged in a series of banks at different levels and successive banks extending transversely to each other whereby the seatings at said successive levels are provided in alternate pairs of said side walls of the chamber.

In this arrangement, which is not necessarily limited to use for fluidised bed applications, the banks of tubes can be pitched so that the tubes of successive banks are almost touching, if this is required, and the total tube surface area can be correspondingly greatly increased for a given chamber volume.

By using mutually transversely extending series of tubes in this manner, it is possible to provide external tube supports so arranged that the transverse forces on one tube can be at least partly transferred to another adjacent tube as an axial force thereon, which the ceramic material is better able to resist.

In fludised bed applications, the banks of tubes will be normally disposed at horizontal or near horizontal levels, but in other heat exchange apparatus the tubes may be oriented in other directions. The references to the different levels are therefore relative and are not intended to imply that the banks are necessarily spaced in the absolute vertical direction.

According to another aspect of the present invention, in order to mitigate the relative fragility of ceramic materials, there is provided a tubed heat exchange apparatus comprising a chamber that has a series of ceramic tubes extending therethrough for a fluid flow in heat exchange with the chamber interior, wherein said tubes are provided with internal support means intermediate their length reinforcing them against bending stresses.

By these means it is possible to employ tubes with thinner walls and/or in greater lengths, so that increases are possible both in the efficiency of operation and in the maximum size of heat exchanger that can be constructed. Said internal support means can take the form of elongate load-carrying elements provided with spacer members that engage the internal walls of the tubes in order to transfer loads from the tubes to the load-carrying elements. Additionally there may be elements supporting the tubes externally as aforementioned.

More especially in a fluidised bed heating apparatus it is important to take precautions against rupture of any of the ceramic tubes, because if that occurs the material of the bed may seriously contaminate the hot gas flow through the tubes with solid particles from the combustion process. This danger must therefore be countered before it can be practical to use ceramic constructions for producing a hot clean gas flow by fluidised bed operation. But as already mentioned, it is not possible to make the tubes stronger by increasing their wall thickness because that would impair the efficiency of heat transfer.

In a preferred construction, therefore, the supporting means comprise one or more restrictions in the internal cross-section of the tubes, such that the flow of the fluid through a tube is retarded after passing through a restriction therein.

By this means, if ash or dust particles are entrained in the gas stream through a tube, because of cracking of the tube for example, the particles will tend to settle out as the speed of the gas stream drops after passing through a restriction. As they gradually accumulate they increasingly block flow through that tube while the total gas flow is largely unaffected because it is carried by the remaining undamaged tubes. The restrictions may take the form of one or more orifices in the tube interior, but additionally or alternatively, one or more mesh or porous members may be disposed inside the tube for flow restriction.

As already indicated the cumbersome nature of satisfactory ceramic tube seals added to the problem of sealing at high pressures is another reason for the limitations in performance of a ceramic heat exchanger compared with a metal construction, and it will be understood from preceding comments that this can be particularly relevant to fluidised bed apparatus.

According to another aspect of the present invention, there is provided heat exchange apparatus comprising a ceramic-walled chamber traversed by ceramic tubes for a fluid flow in heat exchange with a material in the chamber, the tubes extending between apertures in opposite side walls of the chamber and having ceramic fibre sealing means in said apertures, said sealing means comprising resilient end seals held compressed between outer abutments and the tube ends but permitting relative thermal expansion between said abutments and the tubes.

The invention will be described by way of example with reference to the accompanying schematic drawings.

BRIEF DESCRIPTION OF THE DRAWINGS

FIG. 5 is a detail view of tube support means in the heat exchange apparatus of FIG. 4, FIGS. 6 and 7 are further illustrations of the two alternative forms of support means in FIG. 5, FIGS. 8 to 11 are detail sectional views showing alternative end seal arrangements for the ceramic tubes of the heat exchangers of the preceding figures, and FIG. 12 is an exploded view of a part of FIG. 11.

DESCRIPTION OF THE PREFERRED EMBODIMENTS

Figure 1:
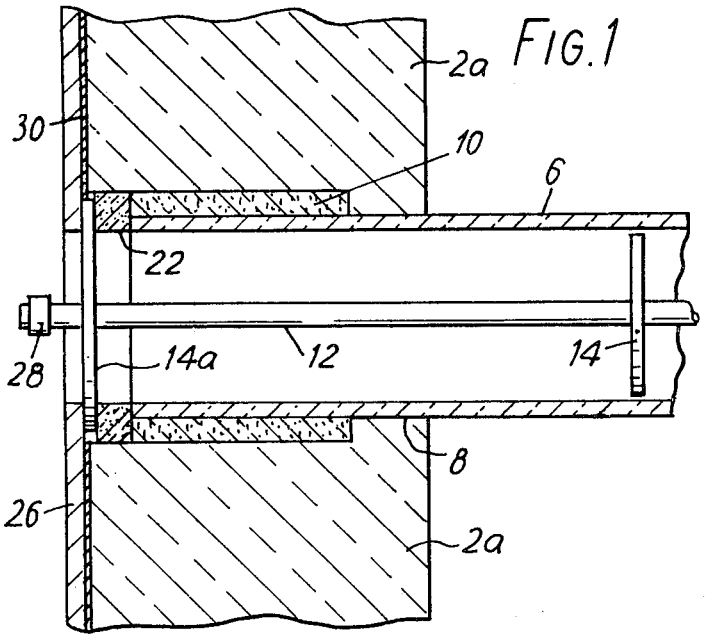
FIG. 1 is an axial section of an end portion of one tube of a ceramic heat exchange apparatus according to the invention.
Figure 2:
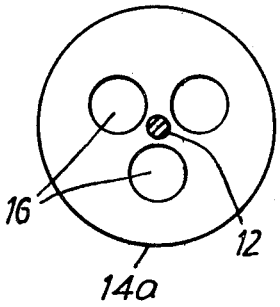
FIG. 2 is an end view of an end spacer element in the construction shown in FIG. 1.
Figure 3:
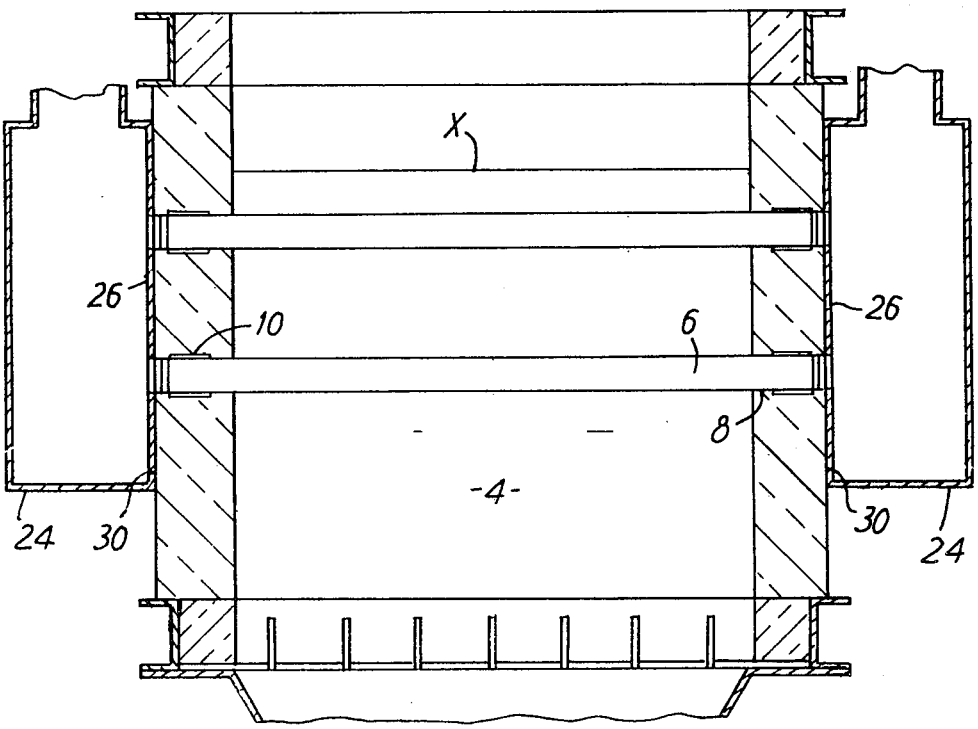
FIG. 3 is an axial section of a heat exchange apparatus according to the invention that incorporates the features shown in FIGS. 1 and 2.

Referring initially to FIGS. 1 to 3 of the drawings, the ceramic heat exchange apparatus comprises a casing 2 the walls of which are composed of ceramic blocks **2*a* and define an internal chamber 4 through which run ceramic tubes 6 for a flow of fluid, e.g. air, to be heated by the heat of combustion in a fluidised bed in the chamber, the bed level being indicated at X. The casing walls are generally constructed in the manner indicated in our U.S. patent application Ser. No. 9769 filed Feb. 6, 1979 (the contents of which are incorporated herein by reference), and in particular the ends of the tubes are received in recesses 8 between individual wall blocks 2*a* that form a pair of opposed chamber side walls between which the tubes extend, sealing between the tubes and these recesses being obtained by precompressed ceramic fibre seals 10**.

A rod 12 extends through each tube and is located centrally in its tube by spacer discs 14 fixed at intervals along its length. Fixed to the ends of the rod are slightly larger discs **14*a* in the casing wall recesses 8 beyond the ends of the tube. The end discs 14*a* bear against auxiliary precompressed ceramic fibre seals 22 between the discs and the tube ends and locate the rod axially. The discs 14*a* are held against the seals 22 to apply a precompression force by axial engagement means such as apertured end plate 26 of a header 24 (FIG. 3) clamped against the casing wall with a ceramic fibre gasket 30** interposed.

All the discs have holes 16 in them that allow fluid to pass through the tubes but that form restrictions so that the flow speeds up as it goes through the holes and then slows downs as the flow passage increases again after each disc. For assembly, all the spacer discs except one end disc **14*a* are firmly attached to the rod before it is inserted in its tube. The final disc may then be added, positioning of the disc putting the auxiliary ceramic end seals 22 under some degree of compression. If necessary a securing element 28** such as a nut screwthreaded onto the end of the rod, or a circlip can prevent the rod slipping out of this end disc.

The arrangement allows for differential thermal expansion between a rod and its tube, which is likely to occur because the rods will be of a relatively high strength material, such as a heat resistant metal alloy, having a different thermal expansion rate and could otherwise either apply an undesirably large compression load to the ceramic tube at one temperature level or be able to shift axially at another temperature level.

If the ceramic tube should crack while in use the rod spacer discs act as locating supports to hold the tube in position so as to limit the strains, for example from buffeting forces, that might otherwise rapidly lead to complete destruction of the tube. In this state, however, it is possible for particles of the fluidised bed material to seep into the tube if the bed pressure is higher than the gas pressure in the tubes. The abrupt velocity changes brought about by the apertured spacer discs will then tend to cause these solid particles to be deposited in the regions immediately downstream of the spacer discs, where the velocity drops. As the solid matter builds up in these regions the damaged tube is gradually blocked while flow continues through the undamaged tubes because of the lower overall pressure drop in these, so that at least a significant part of the foreign matter entering the tube is prevented from being carried away in the heated gas flow.

Instead of apertured discs, the spacer elements may be formed by a mesh or by a porous mass which can similarly act as a suitable restriction of the tube cross-section, provided these or other elements give the required degree of support between the tube and the reinforcing rod 12.

Figure 4:
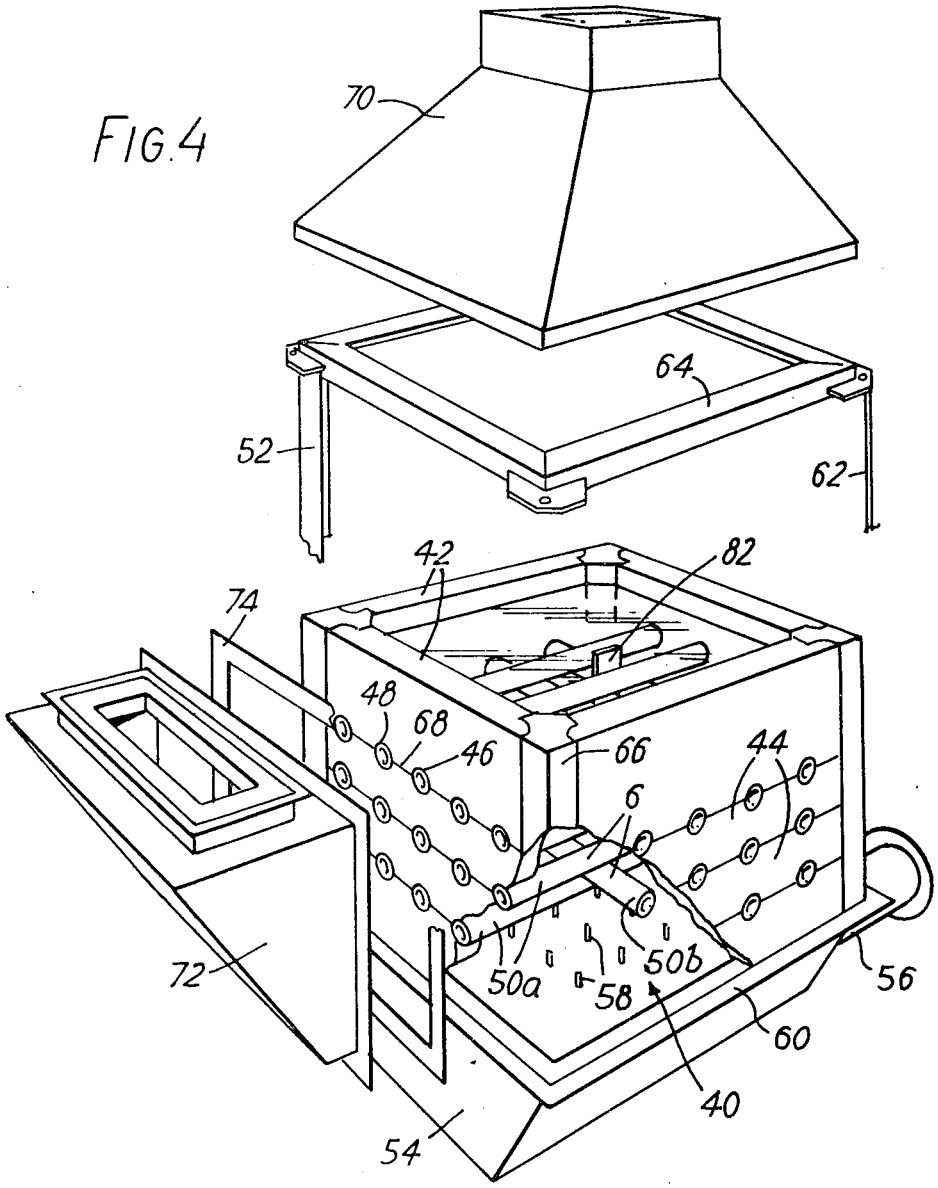
FIG. 4 is an exploded perspective view of a further heat exchange apparatus according to the invention.

In FIG. 4 a further ceramic heat exchange apparatus for a fluidised bed is illustrated. As in the preceding embodiment, the chamber 40 is of rectangular plan form and has side walls 42 that comprise a series of ceramic blocks 44 laid one above the other and with recesses in their upper and lower edges that are in registration to form cylindrical openings that provide seatings 46 for seal arrangements 48 for the ceramic tubes 6 that extend through the chamber within the casing.

In this case, tube sealing arrangements are provided in all four side walls for the tubes which are arranged at successive levels in banks 50*a*, 50*b* at right angles to each other so that for each side wall the ceramic blocks 44 have heights equal to twice the vertical pitch of the centers of the banks of tubes. The arrangement of the tubes in mutually transverse banks makes it possible to pitch the successive banks very closely to each other without the wall blocks being unduly weakened by the formation of the recesses, even though the recesses 46 seating the tube end seals have a diameter greater than the tubes themselves. Thus, if the tube seatings 46 in each side wall are spaced at a vertical pitch of 2.5 times the tube diameter, then the effective vertical pitch of the successive banks of tubes is 1.25 times the tube diameter: this is considerably lower than 1.8 times the tube diameter that is the minimum that can be achieved with the most compact designs already known.

In each side wall the tube seatings are shown in vertical alignment at successive levels, i.e. on a rectangular matrix, but alternative rows of seatings can be staggered, i.e. giving a diamond matrix, if preferred.

FIG. 4 shows a number of constructional details applicable to but not illustrated in the earlier figures. For example, this figure illustrates how the ceramic wall blocks of the casing are mounted in an outer metal main frame 52 comprising a bottom casing part 54 provided with inlet conduits 56 leading to injection nozzles 58 for the combustion and fluidising materials of the fluidised bed. From a peripheral flange 60 of the bottom casing part, tie rods 62 extend upwards to secure a top frame 64 abutting onto the main frame 52. Between the ceramic side walls are ceramic corner posts 66 of a precisely controlled height forming distance pieces that, when the top frame 64 is bolted down by the tie rods 62, determines the degree of compression of the tube end ceramic seals 48 and also of ceramic fibre gaskets 68 laid between successive wall blocks. Forming the top of the chamber is a ceramic-lined waste gas duct 70 of sufficient height to prevent the carry-over of sand or other medium-sized particles from the fluidised bed during operation.

As in the example of FIG. 3, header boxes 72 are provided at the casing side walls and are sealed by ceramic fibre gaskets 74 when bolted to the main frame 52. FIG. 4 does not show the means for internal tube support and for limiting or preventing carry-over of solid material leaking into the ceramic tubes as these means have already been described above.

Because of the arrangement of mutually transverse banks of tubes in FIG. 4, header boxes are provided at all four sides of the casing, although only one box is shown for sake of clarity. Depending on the requirements of the user these boxes may be connected in different ways.

If large quantities of fluid at moderate temperatures, e.g. up to 350° C., are required then the header boxes of adjacent pairs of side walls can be connected together so that the two mutually transverse series of tubes provide two fluid passes in parallel.

If smaller quantities of fluid at higher temperatures, e.g. up to 800° C., are required then the two passes could be connected in series: the air or other gas to be heated would then flow through one series of parallel tubes between one opposed pair of headers and then to a third header leading to the other series of parallel tubes before exiting from the fourth header opposite that third header. This arrangement gives a simpler header box construction than would be needed if each pass utilised a pair of each series of parallel tubes, but because the volume of the fluid increases as it is heated, in the second pass its velocity would increase if both passes have the same number and size of tubes. The rectangular plan form of the fluidised bed can be elongated, however, so that with an optimum lateral tube spacing of both series of tubes, there is a greater total cross-sectional area available for the second pass than foeral tube spacing of both series of tubes, there is a greater total cross-sectional area available for the second pass than for the first pass as the fluid temperature rises and its own density decreases. The velocity through the second pass can then be held at a reasonable level to avoid an excessive pressure drop in the second pass as compared with the first pass.

Mention has already been made of the need to strengthen the ceramic tubes to withstand buffeting and prevent fracture within the fluidised bed. A further means by which this can be done and which can be used additionally to or independently of the internal reinforcing means already described, is illustrated in FIGS. 5 to 7. This takes the form of external supports 82 extending between adjacent tubes and in particular between mutually transverse tubes. The supports may be made of heat resistant metals or ceramic materials, depending upon their operating temperature, and have flexible bearing means through which they engage the ceramic tubes since direct contact from such rigid members might itself create local stresses that would fracture a tube.

Each support comprises arcuate backing elements 84 at opposite ends of a connecting web 86. The bearing means comprise ceramic fibre pads 88 supported in the backing elements which have inturned flanges 90 along their upper or lower free edges that form retaining recesses for the pads 88. The ceramic fibre pads are pre-compressed during manufacture and held rigidly in that state by a suitable setting resin that degrades when the pads are first used. As manufactured their thickness is somewhat less than the spacing between the arcuate backing elements and the associated tube, as indicated at 88*a* on the right-hand of FIG. 5. During the initial firing of the fluidised bed the setting resin burns out of the pad, e.g. at about 300° C., whereupon the ceramic fibres are able to expand to grip the ceramic tubes while providing cushioning between the tubes and the rigid supports. After this initial stage the tubes are resiliently restrained by the ceramic fibre pads so that some movement is still permitted if a force is experienced and damage to the tubes is effectively minimised.

The backing elements in most instances are so formed that they do not extend to the levels of the centres of their associated tubes where the tubes have supports engaging them both from above and from below so that the forces on the tube from the support elements are balanced. For the topmost or lowermost series of supports, where this balanced condition does not prevail, it is preferable to extend the backing elements to beyond the level of the centres of the tubes, as indicated by the support 82*a* shown at the right of FIG. 5 and in FIG. 7, so that when the ceramic fibre pads expand they grip the outside of the tube over an extent greater than half the circumference, thereby restraining the tube from excessive vertical movement. Where this is done, the flanges 90 on the backing element must be so arranged as to allow adequate clearance for assembly of the support on the tube.

The supports described are particularly effective in an arrangement in which they extend between mutually transverse tubes, because bending forces in the plane of one bank of tubes will be transmitted as axial forces to the adjacent banks of tubes by the connecting supports. If additional reinforcement is required against bending forces acting transversely to the planes of the banks of tubes, it is possible to provide further supports from the bottom bank of tubes to the floor of the chamber, and possibly similar supports from the top bank of tubes to a top wall or to the top duct of the chamber.

Alternative end seal arrangements for the heat exchanger tubes are illustrated in FIGS. 8 to 12. Parts already described are indicated by the same reference numbers.

Figure 8:
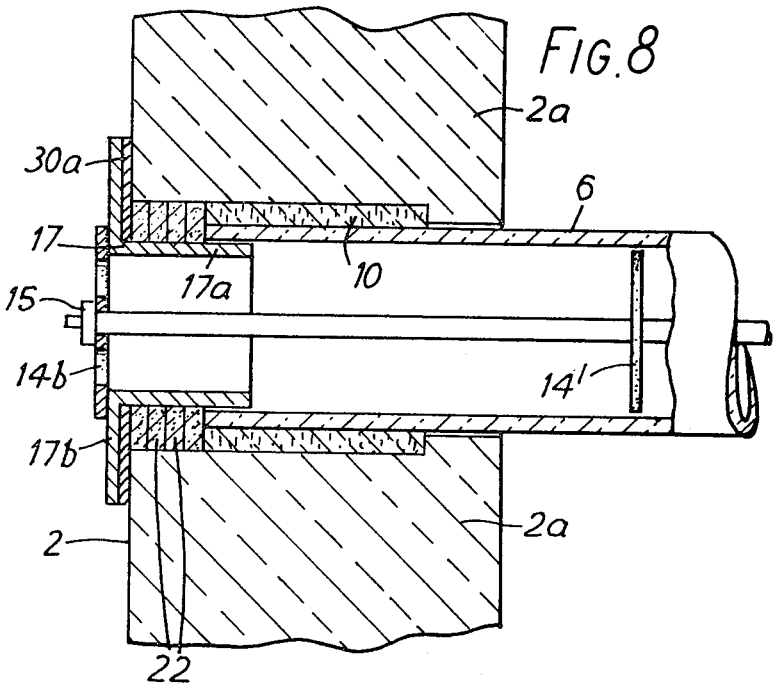

In FIG. 8 the previously described support rod 12 of each tube is extended beyond the side walls 2 and the apertured end disc 14*b* is held by securing nut 15 against a flanged cap 17. The cylindrical portion 17*a* of the flanged cap is a loose fit within the end of the ceramic tube 6 so that it does not stress it but it is nevertheless located substantially coaxially with it. Tightening the nut 15 clamps the cap flange 17*b* against the chamber outer face with a gasket 30*a* interposed. The cap cylindrical portion 17*a* engages the end seals 22 radially and the cap can therefore support the seals against possible creep in successive expansion and contraction cycles. This arrangement is able to provide a very tight seal capable of withstanding pressure differences of several atmospheres between the two flows that are in heat exchange.

By way of illustration, FIG. 8 also shows a spacer disc 14' formed of a mesh body or a porous mass, as mentioned above.

Figure 9:
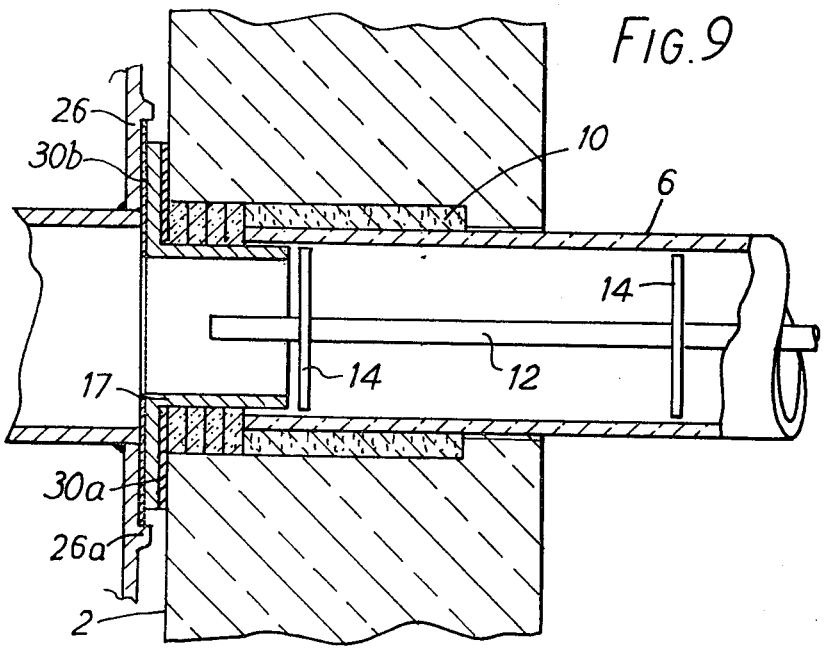

FIG. 9 shows how, where a header box is provided (as in FIG. 3), this can bear against the flanges 17*b* of the caps with additional gaskets 30*b* interposed. FIG. 9 also shows a further modification in that the cap is secured and the axial pressure applied to the seals 22 by the header tube plate 26. The additional gaskets 30*a* are located centrally by annular shoulders 26*a* of the tube plate. With this clamping method, if an internal tube support arrangement is provided as already described, the supporting rod 12 need not be fixed to the flanged cap 17 and FIG. 9 shows a free-floating arrangement. Displacements of the rod are limited by the caps 17 at opposite ends of the tube 6, which form stops for the end discs 14, but a sufficient gap is left for all thermal expansion movements.

In a relatively low pressure system, the flanged caps 17 compressing the seals 22 can be axially located by the side walls themselves. FIG. 10 shows a retaining pin 102 held in accurately positioned holes 104 in the wall blocks 2*a* and bearing against the cap flange 17*b*. If a supporting rod arrangement is provided, its displacements can be limited by the pins or by the flanged caps 17.

An alternative low pressure system is shown in FIGS. 11 and 12, where tabs 106 of a high-temperature alloy fit recesses 108 in the edges of the wall blocks 2*a* and have rear lips 110 that are retained in a channel 112 along the edge of the block 2*a* (the primary purpose of the channels 112 is to locate the ceramic fibre seals that are laid between adjoining wall blocks). Slots 114 in the outer ends of the tabs are engaged by the tube end caps 17 that have slots 116 in their flanges 17*b* through which the end tongues 118 of the tabs can be passed. During assembly, after a group of wall blocks 2*a* and tabs 106 are assembled, the tubes 6 and their seals 10,22 are fitted. The end gaskets 30*a*, which are also slotted to fit over the tabs 106, are put in place and the flanged caps 17 are inserted through the end seals 22 into the tubes, with the flange slots 116 oriented to slide over the tab tongues 118. When axially positioned, the caps are rotated to trap their flanges 17*b* in the tab slots 114, as shown in FIG. 12, the caps 17 then holding the seals 22 compressed.

The constructions described above may be used for a variety of applications. One particular example is to provide hot air, e.g. for industrial process applications, and if required a heated air flow at temperatures up to 800° C. can be provided for such purposes as drying.

It has already been mentioned that the use of the invention is not necessarily restricted to fluidised bed applications. The arrangement of the banks of tubes in mutually transverse series in particular is a feature that can be used to good effect in gas to gas heat exchangers, for example, where compactness of the heat exchanger is an important factor. Also, if it is required to install the heat exchanger in an existing conduit where the flow velocity is relatively slow, a large waste gas duct for example, the relatively closely packed mutually transverse banks of tubes can restrict the cross-section so as to increase considerably the flow velocity in the conduit and thereby improve the heat transfer rate.

What is claimed is:

1. Heat exchange apparatus for high temperature gas heating comprising a chamber for a first heat exchange medium containing a fluidised bed material, conduit means below said chamber and communicating with said chamber for the supply of fluidising and combustion material to said chamber for maintaining fluidised bed combustion in said chamber as a heating medium, a multiplicity of ceramic tubes for a gaseous medium to be heated extending through the fluidised bed in said chamber to opposite and mutually transverse pairs of side walls bounding said chamber, each said side wall comprising a series of parallel ceramic blocks superimposed on each other edge to edge, recesses formed in said edges of the blocks providing seatings between adjacent blocks for said ceramic tubes extending through the chamber, sealing means in said seatings for sealing between the ends of the tubes and the side walls, said tubes being arranged in a series of banks at different levels in said chamber and sucessive banks of tubes at successive levels extending transversely to each other, whereby the seatings at said successive levels are provided in alternate pairs of said mutually transverse pairs of side walls of the chamber, said sealing means comprising flexible seal elements engaging the end faces of the tubes and retaining means bearing on said seal elements at their axially outer ends.

2. Heat exchange apparatus according to claim 1 wherein tube support elements are provided in the chamber extending between opposed upper and lower surfaces of adjacent mutually transverse tubes overlying each other, and flexible bearing means are disposed between said support elements and the tubes for transmission of the support loads therebetween.

3. Heat exchange apparatus for high temperature gas heating comprising a chamber having ceramic walls, means for establishing a fluidised bed combustion process in said chamber, and a series of ceramic tubes traversing the chamber between opposite walls for a gas flow in heat exchange with the fluidised bed in the chamber, apertures being provided in at least one opposite pair of side walls of the chamber, the tubes having opposite end faces in said apertures, ceramic fibre sealing means in said apertures for said end faces of the tubes, said sealing means comprising resilient end seals and outer abutment means spaced from the tube end faces holding said end seals compressed against the tube end faces, but permitting resilient deformation of said end seals for relative thermal expansion between said abutment means and the tubes, means for retaining said abutment means in place relative to the chamber walls, extensions being provided on the abutment means projecting towards the tubes, said extensions providing cylindrical supports for the radially inner faces of said end seals.

4. Heat exchange apparatus according to claim 3 wherein fluid conduit means are disposed externally of the chamber communicating with said tubes and said abutment means are secured in place by said fluid conduit means.

5. Heat exchange apparatus according to claim 3 wherein engagement elements locating in recesses in the side walls releasably engage with the abutment means secure said abutment means in place.

6. Heat exchange apparartus according to claim 5 wherein said engagement elements are disposed internally within the side walls and outer ends of said abutment means are located within said side walls by said elements.

7. Heat exchange apparatus according to claim 5 wherein said engagement elements project outwardly from said side walls.

8. Apparatus according to claim 3 wherein internal support means for the tubes are provided in the tubes comprising elongate elements extending through the tubes and opposite end elements carried on said elongate elements form said abutment means.

9. Heat exchange apparatus according to claim 3 wherein internal support means for the tubes are provided in the tubes comprising elongate elements extending through the tubes and opposite end elements carried on said elongate elements secure said abutment means in place.

10. Heat exchange apparatus according to claim 3 wherein said cylindrical supports project into the end regions of the tubes to be located coaxially therewith but to be displaceable axially relative thereto.

11. Heat exchange apparatus according to claim 3 wherein said means for retaining the abutment means in place comprise external engagement means located externally of said side walls, said abutment means being held between the engagement means and the side walls.

12. Heat exchanger apparatus for high temperature gas heating comprising a chamber for a first heat exchange medium containing a fluidised bed material, conduit means below said chamber and communicating with said chamber for the supply of fluidising and combustion material to said chamber for maintaining fluidised bed combustion in said chamber as a heating medium, a multiplicity of ceramic tubes for a gaseous medium to be heated extending through the fluidised bed in said chamber to opposite and mutually transverse pairs of side walls bounding said chamber, each said side wall comprising a series of parallel ceramic blocks superimposed on each other edge to edge, recesses formed in said edges of the blocks providing seatings between adjacent blocks for said ceramic tubes extending through the chamber, sealing means in said seatings for sealing between the ends of the tubes and the side walls, said sealing means comprising flexible seal elements engaging the ends of the tubes and retaining means bearing on said seal elements at their axially outer ends, said tubes being arranged in a series of banks at different levels in said chamber and successive banks of tubes at successive levels extending transversely to each other, whereby the seatings at said successive levels are provided in alternate pairs of said mutually transverse pairs of side walls of the chamber, tube support elements being provided in the chamber extending between opposed upper and lower surfaces of adjacent mutually transverse tubes overlying each other, and flexible bearing means being disposed between said support elements and the tubes for transmission of the support loads therebetween, said bearing means comprising ceramic fibre pads and a rigid material constraint for preshaping said pads and precompressing the ceramic fibres, said rigid material constraint being adapted to be released from the pads by the heat of operation of the apparatus to permit the ceramic fibres thereafter to act resiliently.

* * * * *